US005477892A

United States Patent [19]

Corain et al.

[11] Patent Number: 5,477,892

[45] Date of Patent: Dec. 26, 1995

[54] DEVICE FOR REGULATING FEELER SENSITIVITY IN CONTROL OF LOOM WEFT INSERTION

[75] Inventors: Luciano Corain, Vicenza; Ruggero Manzardo, Schio, both of Italy

[73] Assignee: Nuovopignone-Industrie Meccaniche E Fonderia S.p.A., Florence, Italy

[21] Appl. No.: 239,563

[22] Filed: May 9, 1994

[30] Foreign Application Priority Data

May 18, 1993 [IT] Italy ..... MI93A1011

[51] Int. Cl.[6] ..... D03D 47/38; D03D 51/18; D03D 51/34

[52] U.S. Cl. ..... 139/450; 139/370.2; 139/453

[58] Field of Search ..... 139/450, 370.2, 139/453

[56] References Cited

U.S. PATENT DOCUMENTS

| | | | |
|---|---|---|---|
| 4,381,803 | 5/1983 | Weidmann | 139/370.2 |
| 4,476,901 | 10/1984 | Sainen | 139/370.2 |
| 4,546,263 | 10/1985 | Gotoh et al. | 139/370.2 |
| 4,919,172 | 4/1990 | Riezler et al. | 139/450 |
| 5,031,669 | 7/1991 | Wahhoud et al. . | |
| 5,107,905 | 4/1992 | Shaw et al. | 139/450 |

FOREIGN PATENT DOCUMENTS

| | | | |
|---|---|---|---|
| 874724 | 3/1979 | Belgium | 139/453 |
| 0285872 | 10/1988 | European Pat. Off. . | |
| 0352852 | 1/1990 | European Pat. Off. . | |
| 2059459 | 4/1981 | United Kingdom | 139/453 |

*Primary Examiner*—Andy Falik

*Attorney, Agent, or Firm*—Oblon, Spivak, McClelland, Maier & Neustadt

[57] ABSTRACT

A device for continuously regulating the feeler sensitivity in the control of weft insertion in a loom. The device includes a selector having a memory into which the sensitivity value corresponding to the count of the weft passing through the eye of each rod is fed. The selector is electrically connected to a piezoelectric sensor-comparator, and is controlled by a logic control unit. The logic control unit provides electrical pulses or signals for selecting weft presenter rods of a presenter, and the same signal from the logic control unit is provided to the selector, such that the selector utilizes the signal from the logic control unit for providing the feeler sensitivity information to the sensor-comparator.

1 Claim, 1 Drawing Sheet

DEVICE FOR REGULATING FEELER SENSITIVITY IN CONTROL OF LOOM WEFT INSERTION

BACKGROUND OF THE INVENTION

1. Field of the Invention

This invention relates to a device which, by allowing continuous regulation of feeler sensitivity of the piezoelectric weft passage sensor-comparator on the basis of the count of the wefts selected at any given time by the presenter, enables weaving to be effected with wefts of different count without halting the loom.

2. Discussion of Background

As is well known, in a loom the wefts originating from the bobbins are passed through the eyes of the presenter rods after traversing the channels of the piezoelectric weft passage sensor-comparator. The channels generate an electric current, the value of which is a function of the count of the wefts traversing them, this value being compared with the feeler sensitivity set by the logic unit, which halts the loom if this comparison gives a negative result. From the foregoing it follows that the use of such a weft presence sensor-comparator means that currently only wefts with the same count, and more precisely with a count corresponding to the set sensitivity, can be woven. In this respect, only one sensitivity value can be set, this value remaining constant during the entire loom operation and being changeable only by halting the loom and setting the new value, leading to a considerable reduction in loom efficiency, hence the wefts used have to be of constant count.

SUMMARY OF THE INVENTION

The object of the present invention is to obviate the above drawback by providing a device which enables the feeler sensitivity of the piezoelectric sensor-comparator to be continuously regulated on the basis of the count of the wefts being used at any given time while the loom is in operation, which count can hence differ from weft to weft without this causing undesirable loom stoppage. This is substantially attained in that when the various weft yarns have been inserted through the eyes of the various presenter rods and hence knowing the count of the weft relative to each rod, the electrical pulses for selecting the presenter rods are also used for selecting, from the predefined assembly of feeler sensitivities relative to said counts of the wefts used, that sensitivity value associated with the specific selected weft, this value being fed into the piezoelectric sensor-comparator for comparison with the current value generated in the weft sensor. Hence, the present invention relates to a device for continuously regulating the feeler sensitivity in the control of weft insertion in a loom which includes a series of feed bobbins for the wefts which are passed through the eyes of the weft presenter rods after traversing the channels of the piezoelectric weft passage sensor-comparator, and an electrically controlled logic unit connected to said sensor-comparator. In accordance with the present invention, a selector is provided with a memory into which for each presenter rod there is fed the feeler sensitivity value corresponding to the count of the weft passing through the eye of said rod, the selector being electrically connected to the piezoelectric sensor-comparator and being controlled by the logic control unit with the same electrical pulses as used for selecting the rods of the weft presenter.

BRIEF DESCRIPTION OF THE DRAWING

A more complete appreciation of the invention and many of the attendant advantages thereof will be readily obtained from the following description, particularly when considered in conjunction with the drawing in which:

The drawing FIGURE schematically represents a non-limiting example of an embodiment of the present invention.

DESCRIPTION OF THE PREFERRED EMBODIMENT

Figure 1:
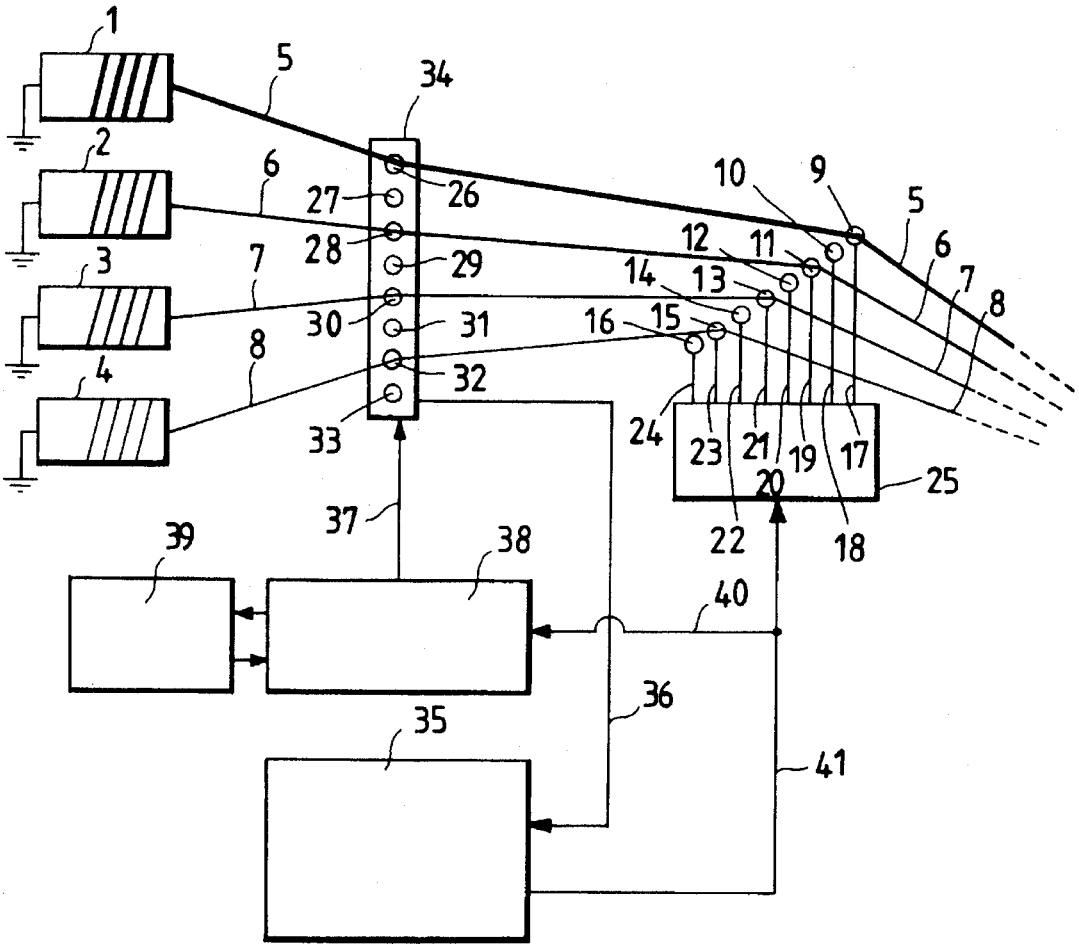

In the drawing, the reference numerals 1, 2, 3 and 4 indicate the bobbins which feed the wefts to be woven, 5, 6, 7 and 8 respectively, which have different counts. The wefts 5–8 are made to pass through those eyes 9, 11, 13 and 15 of the eyes 9–16 of the rods 17–24 of the loom weft presenter 25, after traversing the channels 28, 30 and 32 respectively of the channels 26–33 of the piezoelectric sensor-comparator 34. The sensor-comparator 34 feeds the result of the comparison to the logic control unit 35 via the cable 36 and obtains the feeler sensitivity set value, via the cable 37, from a selector 38, the memory 39 of which for each operating rod 17, 19, 21 and 23 of the presenter 25 has been fed with the feeler sensitivity value corresponding to the count of the relative wefts 5, 6, 7 and 8 respectively. The selector 38 is controlled, via the cable 40, by the logic control unit 35 with the actual electrical pulses (or selector signal) used, via the cable 41, for selecting the rods 17–24 of the weft presenter 25.

The method of operating such a device is now apparent. Each time the logic control unit 35 selects a weft and consequently a rod of the presenter 25, it also automatically selects, via the selector 38, the feeler sensitivity which has previously been fed into the memory 39, and with which the piezoelectric sensor-comparator 34 has to compare the current signal generated by the selected weft. In this manner the feeler sensitivity always takes account of the count of the weft used and varies as this varies, so that wefts of a different count can now be used without the danger of loom stoppage.

Obviously, numerous modifications and variations of the present invention are possible in light of the above teachings. It is therefore to be understood that within the scope of the appended claim, the invention may be practiced otherwise than as specifically described herein.

We claim:

1. A device for continuously regulating feeler sensitivity in the control of weft insertion in a loom comprising:

a presenter including a plurality of weft presenter rods, each including an eye;

a piezoelectric weft passage sensor-comparator having channels;

a series of feed bobbins for providing wefts which are passed through the eyes of the weft presenter rods after passing through the channels of the piezoelectric weft passage sensor-comparator;

a selector including a memory for being fed, for each presenter rod, a feeler sensitivity value corresponding to a count of the weft passing through the eye of each rod; and a logic control unit;

the device further including means for feeding a result of a comparison of the piezoelectric sensor-comparator to the logic control unit, means for providing the feeler sensitivity value from the selector to the piezoelectric sensor-comparator, and means for providing a selector signal from the logic control unit to the presenter for selecting wefts and weft presenter rods, and further including means for providing said selector signal to said selector such that said selector is controlled by the logic control unit with the same selector signal utilized for selecting weft presenter rods of said presenter, whereby upon selection of a weft and weft presenter rod by said logic control unit the feeler sensitivity value previously fed into the memory is automatically selected by said selector.

* * * * *